US006666210B2

(12) United States Patent
Semeia

(10) Patent No.: US 6,666,210 B2
(45) Date of Patent: Dec. 23, 2003

(54) DIVING MASK WITH COMPENSATION MEANS

(75) Inventor: Roberto Semeia, San Salvatore Di Cogorno (IT)

(73) Assignee: Scubapro Europe S.r.l. (IT)

( * ) Notice: Subject to any disclaimer, the term of this patent is extended or adjusted under 35 U.S.C. 154(b) by 290 days.

(21) Appl. No.: 09/794,123

(22) Filed: Feb. 28, 2001

(65) Prior Publication Data

US 2001/0022180 A1 Sep. 20, 2001

(30) Foreign Application Priority Data

Mar. 15, 2000 (IT) ..... GE2000A0040

(51) Int. Cl.[7] ..... A62B 18/02

(52) U.S. Cl. ..... 128/207.13; 128/206.21; 128/201.27

(58) Field of Search ..... 128/200.21, 201.11, 128/201.22–201.24, 202.11, 203.29, 204.18, 205.22, 205.25, 206.12, 206.21–207.18

(56) References Cited

U.S. PATENT DOCUMENTS

| | | | | | |
|---|---|---|---|---|---|
| 1,978,994 | A | * | 10/1934 | Fortunato | 128/201.27 |
| 3,027,561 | A | | 4/1962 | Senne | |
| 3,653,086 | A | | 4/1972 | Gongwer | |
| 4,077,068 | A | * | 3/1978 | Anderson | 2/428 |
| 4,294,243 | A | | 10/1981 | Ernsting et al. | |
| 4,352,353 | A | * | 10/1982 | Bolton et al. | 128/201.24 |
| 5,572,989 | A | * | 11/1996 | Lutz et al. | 128/201.18 |
| 6,302,103 | B1 | * | 10/2001 | Resnick | 128/201.23 |

* cited by examiner

*Primary Examiner*—Glenn K. Dawson
(74) *Attorney, Agent, or Firm*—Larson & Taylor, PLC

(57) ABSTRACT

Diving mask with compensation consisting of an outer frame, suitably shaped, and of an inner face connected to said outer frame. The frame is formed by a body shaped so as to house the diver's nose and provided on the side of at least one nostril of the diver's nose with structure for the compression of said nostril, and on the side of the other nostril with at least one abutment for said nostril. The compression structure is secured to the body and can be operated by the diver from the outside of the mask.

19 Claims, 3 Drawing Sheets

DIVING MASK WITH COMPENSATION MEANS

BACKGROUND AND SUMMARY OF THE INVENTION

The present invention relates to a diving mask provided with compensation means.

As is known, diving masks are usually provided with an outer frame suitably shaped, an inner shapeable face and a housing for the diver's nose, both connected to said frame. In order to carry out the compensation operation the diver introduces his/her fingers into said housing so as to compress his/her nostrils and to put compressed air into his/her aural cavities. Said known masks show several problems: first of all, as far as the mask design is concerned, the stereoscopic vision needs a maximum level of visibility in the area comprising the nose housing (for instance in order to be able to see the various fittings and the buckles placed on the chest), whereas, on the other hand, that same area should be as large as possible in order to allow said compensation operation. For the reasons mentioned above and because of aesthetic requirements the tendency is very often that of limiting the access of the fingers to the nose in the above mentioned area. Such problem becomes even more crucial because of the use of gloves which are often part of the diver's apparel, especially if the latter are very thick, and because of the simultaneous presence of the distributor in the mouth, which closes the possible access to the lower nose portion.

The present invention, therefore, aims at overcoming the problems found out in known masks as far as the compensation operation is concerned, by carrying out a diving mask with compensation in which the nose compression is moved outside the mask glass, in an area where the diver can have an easier access.

Said aim is achieved by the present invention by means of a diving mask with compensation, consisting of an outer frame suitably shaped and of an inner face connected to said outer frame; said frame consists of a body shaped so as to house the diver's nose and provided, on the side of at least one of the nose nostrils, with compression means for said nostril, and on the side of the other nostril with at least one abutment for said nostril, said compression means being fixed to the body and being operated by the diver from the outside of the mask.

According to a further aspect of the present invention the compression means consist of at least one substantially bow-shaped lever, comprising a hammer-shaped end and an end with a handle, said lever being introduced into a housing obtained in the body and connected to said body by means allowing its rotation at least towards the outside of the mask, and said hammer-shaped end being shaped so as to compress the adjacent nostril by rotating said lever.

Therefore, the mask according to the present invention advantageously allows to achieve at the same time the twofold result of enlarging the field of view, by narrowing the nose area, and of being able to easily press the nose (even with thick gloves), since said operation is moved outwards thanks to the lever handle and can be done with only one finger or with any other portion of the hand or forearm.

BRIEF DESCRIPTION OF THE DRAWINGS

Further aims and advantages of the present invention will be better understood during the following description, regarded as a mere non-limiting example and referred to the enclosed drawings, in which.

DESCRIPTION OF THE PREFERRED EMBODIMENTS OF THE INVENTION

Figure 1:
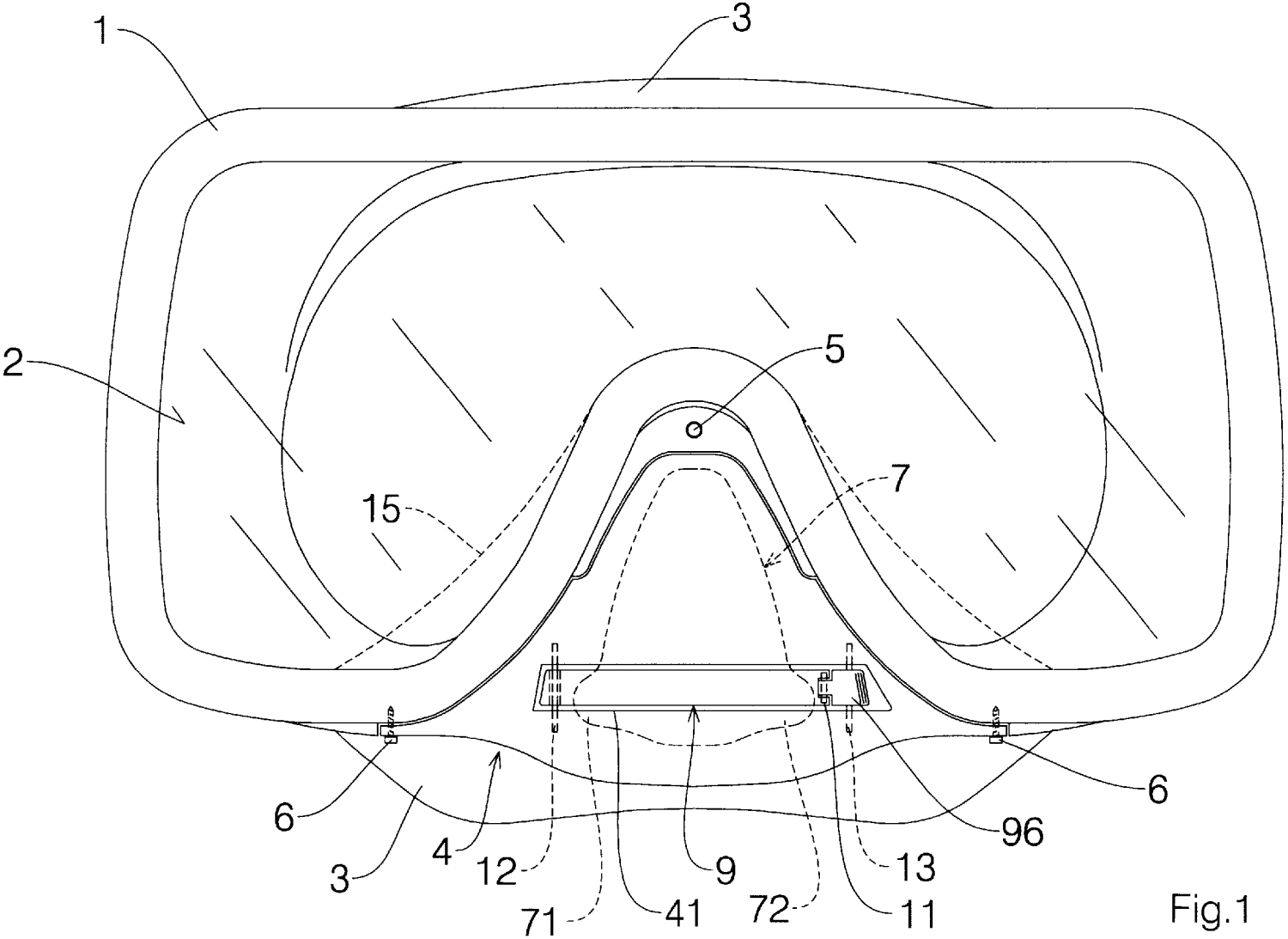
FIG. 1 shows a front view of a form of embodiment of a diving mask according to the present invention, provided with a compensation lever hinged to a front body.
Figure 2:
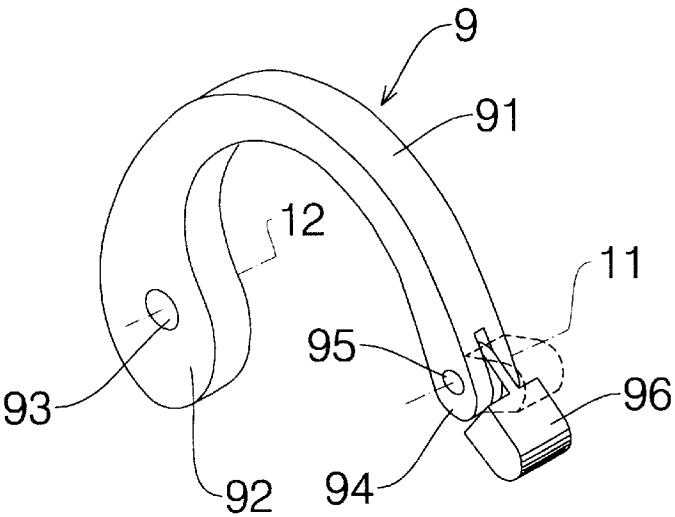
FIG. 2 shows a perspective view of the compensation lever in FIG. 1.

With reference to FIG. 1, the latter shows a front view of a mask consisting of an outer frame 1 to which a glass 2 and a face 3 made of elastomeric material and adaptable to the diver's face are connected. The lower middle portion of the frame 1 is shaped so as to connect to it a body 4 made of stiff material, which is fixed to said frame by means of a fitting element 5 and two lower lateral screws 6. The body 4 has such a shape as to be able to contain the nose 7, which is not in direct touch with the inner surface of said body 4, but it is contained within a housing 8 (whose section can be seen in FIG. 4) obtained as one piece from the face 3 made of elastomeric deformable material. In the present form of embodiment of the mask the body 4 is fixed to the frame 1 by means of the aforesaid screws 6 and the fitting element 5, but it could also be definitively fixed to said frame during the manufacturing of the mask. On the front portion of the body 4, near the base of the nostrils 71 and 72 of the nose 7, a housing 41 has been obtained, the latter housing a compensation lever 9 hidden within said housing 41. Said lever 9, as can be seen from FIG. 2, consists of a bow-shaped arm 91 whose concavity is towards the inside of the mask, said arm showing a first hammer-shaped end 92, having a larger section, near which a first hole 93 is obtained, and a second end 94 in which a second hole 95 is obtained. Said second hole 95 allows the passage of a pin 11 connecting the end 94 of the arm 91 to an element 96 for the grasping and the rotation of the lever 9. Thanks to said pin 11 the element 96 can be rotated in its turn with respect to the lever. The hammer-shaped end 92 of the lever 9, on the other hand, is connected to the body 4 by means of a corresponding pin 12 fixed within the body 4, and it is introduced into the hole 93 of said end 92. The lever 9 can thus rotate with respect to the body 4 and to the housing 41, whereas the corresponding grasping element 96 can rotate with respect to the arm 91 of said lever until the corner of the upper surface touches the surface of the arm 91. In order to avoid that said grasping element 96 goes too deep into the body 4, thus being it impossible for the diver to grasp it, and so that it always shows a certain outer projection with respect to it, an abutment pin 13 has been provided, said pin being fixed onto both sides of the housing 41 of said body 4. It will be against said pin, therefore, that the inner surface of said grasping element 96 will lean when the lever 9 is in its rest position.

Figure 3:
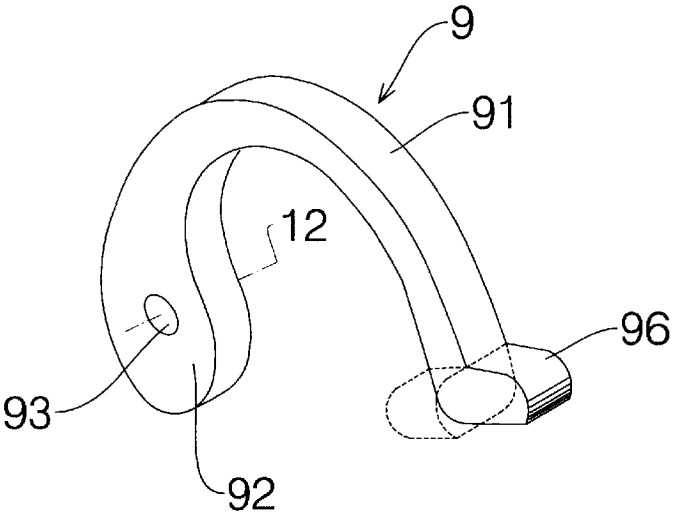
FIG. 3 shows an execution variant of the compensation lever in FIG. 2.

FIG. 3 shows an execution variant of the compensation lever 9, and in particular of the end 94 of the arm 91 carrying the grasping element 96, which, as can be observed, is obtained on said end and fixed to it so as to show a certain front projection with respect to the arch drawn by said arm 91 and therefore with respect to the front surface of the body 4.

Figure 4:
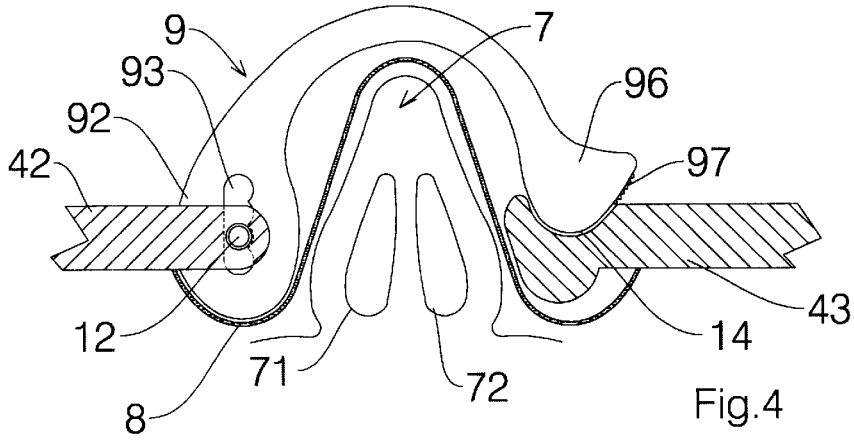
FIG. 4 shows a view from below of an execution variant of the compensation lever in rest conditions, hinged to the lower portion of the body.

The section view from below of FIG. 4 shows, as mentioned before, the housing 8 for the diver's nose 7, said housing being located within the body 4. Said body 4 shows, near a nostril 71 of the nose 7, a support 42 into which a pin 12 for the rotation of the lever 9 is introduced, and, near the other nostril 72, an elastic abutment 43 whose functions will be described later. The compensation lever 9 here shown shows some execution variants with respect to the levers described in FIGS. 2 and 3. First of all, the pin 12 is housed within the second of four holes 93 obtained in the hammer-shaped end 92, thus with the possibility of varying the introduction of said pin 12 into one of said holes 93, according to the diver's nose shape 7, and therefore of varying the position of the lever 9 with respect to the body 4. The grasping element 96, moreover, is obtained as one piece together with said lever 9 and has a front projection which is slightly lower than the shape shown in FIG. 3, and it is provided with a side portion 97 carried out as to simplify its grasping, for instance by means of notches or protuberances obtained on said side portion 97. The inner portion of the grasping element 96 is partially housed within a hollow 14 obtained near the end of the elastic abutment 43. Said hollow 14 has the twofold function of providing a housing for said element 96, when the lever 9 is in its rest position, and of making said abutment elastically deformable, when the lever 9 is at work for the compensation.

Figure 5:
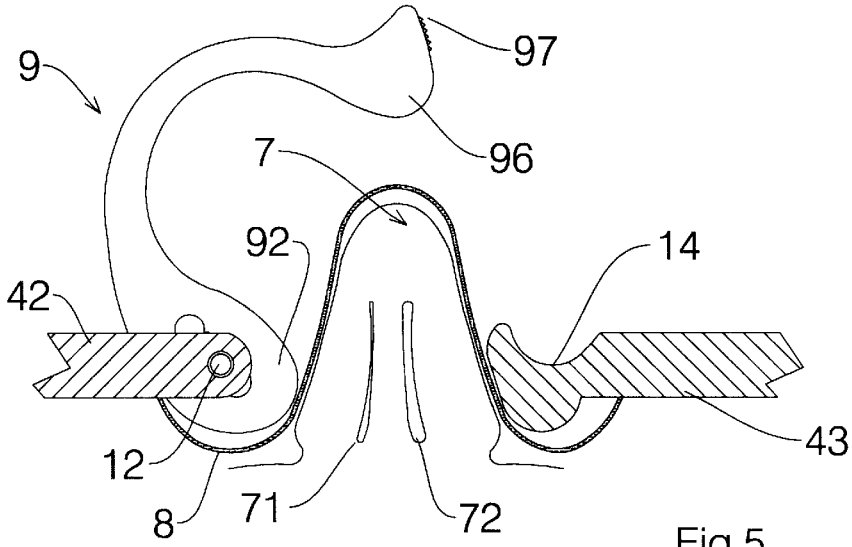
FIG. 5 shows a view from below of the compensation lever in FIG. 4 in working conditions to compress a diver's nose nostril, the other nostril being in touch with an abutment provided on the lower portion of the body.

Let's now see the working of the lever 9. When the diver wants to compress his/her nose 7 in order to introduce air into the aural cavities during a diving session, it is sufficient that, using a finger (or his/her forearm or part of it), he/she grasps the element 96 of the lever 9 and pushes it towards the outside of the mask, so that said lever 9 rotates around the pin 12 till it reaches such a position (see FIG. 5) that the hammer-shaped end 92 pushes onto the housing 8 and closes and compresses the nostril 71 beside it, while the other nostril 72 will lean against the elastic abutment 43 and will also be compressed. Once the compensation has been carried out, the diver only has to switch the lever 9 back to the position shown in FIG. 4.

The compensation lever 9 thus allows an easy and rapid carrying-out of the compensation, and moreover all the operations made by the diver are carried out from the outside of the mask, without touching the nose 7 with his/her fingers, which advantageously allows to carry out an outer frame 1 which, in the area where the nose is housed, is extremely narrower than the normal profile 15 (shown with dashes in FIG. 1) of known masks, thus allowing the attainment of a field of view extensively wider for the scuba diver.

Figure 6:
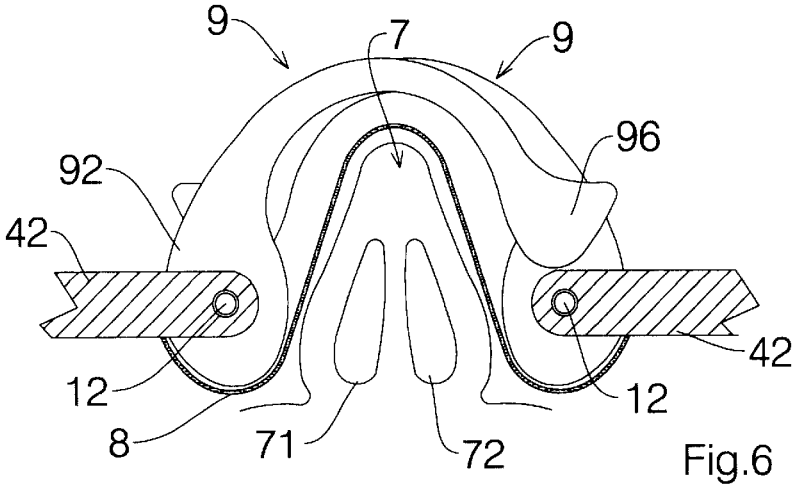
FIG. 6 shows a view from below of a section of the lower portion of the body in which two compensation levers are provided, each acting onto a diver's nose nostril.

FIG. 6 shows an execution variant of the present invention in which, on the lower portion of the body 4, two compensation levers 9 are provided on both sides of the nose 7, and the diver can thus decide to carry out the compensation operation on both nostrils 71 and 72 by rotating said levers 9 in opposite direction towards the outside of the mask; if, on the other hand, he decides for instance to rotate only the lever 9 adjoining the nostril 71, the other nostril 72 will lean against the hammer-shaped end of the lever at rest, said end taking over the function of abutment.

Figure 8:
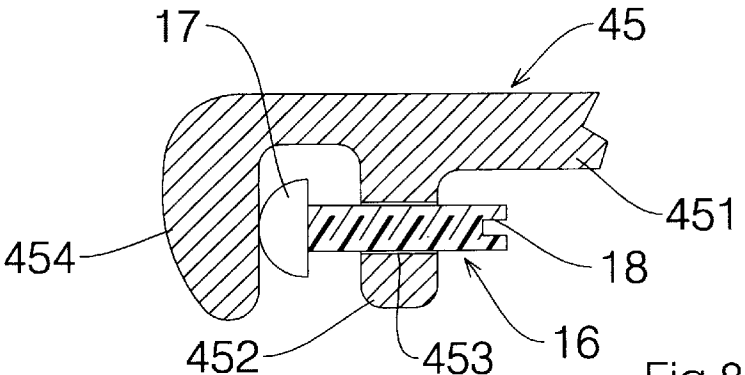
FIG. 8 shows another execution variant of the abutment in FIG. 7.
Figure 7:
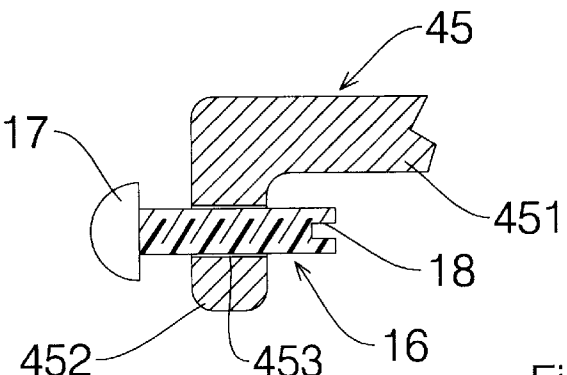
FIG. 7 shows an execution variant of the abutment for a diver's nostril.

As far as the abutments against which the diver's nose nostril lean are concerned, FIGS. 7 and 8 show two execution variants: in FIG. 7 it is possible to observe an adjustable abutment 45, substantially L-shaped and consisting of a stem 451 and of a base 452 on which a threaded hole 453 is obtained, said hole cooperating with a threaded pin 16 partially screwed into said hole 453. Said pin 16 comprises on one end a head 17 for the leaning of the diver's nose nostril and on the other end a notch 18 for the adjustment of its screwing within the hole 453. In this case, therefore, the diver can adjust, for instance by means of a screw-driver introduced into the notch 18, the screwing of the pin 16, and thus the distance between the head 17 and the adjacent nostril.

FIG. 8 shows a variant of the abutment 45 in FIG. 7, according to which said abutment 45 is made elastically deformable and also adjustable by means of the threaded pin 16. In this case the head 17 of said pin 16 does not lean directly onto the diver's nose nostril, and the stem 451 is extended beyond the base 452 and a second base 454 is provided for the leaning of said nostril; between said bases 454 and 452 a housing 455 is obtained, said housing having such dimensions as to allow a certain stroke of the head 17 for the adjustment of the pin 16. When the pin 16 is screwed, the head 17 will elastically deform the base 454 for the leaning of the nostril, whereas, if said head 17 is left at a certain distance from the base 454 with the abutment 45 in its rest position, by means of the loosening of said pin 16, when the diver carries out the compensation operation, said base 454 will get near the head 17 till it leans onto it, then going back to the original position shown in the figure.

I claim:

1. A diving mask with compensation, said diving mask comprising:

an outer frame and an inner face connected to said outer frame;

said frame comprising a body shaped so as to house a diver's nose;

a compression element comprising a compensation lever with a lever end rotatably connected to said body and positioned adjacent one side of a diver's nose when said mask is positioned on the diver's face, said compensation lever being rotatable away from and towards the outside of said mask, thereby urging said lever end to compress at least one of the diver's nostrils, said compensation lever operable by the diver from the outside of the mask; and at least one abutment on a side opposite said compensation lever side and adjacent the other side of a diver's nose when said mask is positioned on the diver's face.

2. The diving mask according to claim 1, wherein said compensation lever with lever end comprises at least a substantially bow-shaped lever comprising a hammer-shaped end and a grasping end having a grasping element, said bow-shaped lever being rotatable at least towards the outside of the mask, and said hammer-shaped end being shaped so as to compress the adjacent nostril by rotating said lever.

3. The diving mask according to claim 2, wherein at least a through-hole is located near said hammer-shaped end, into which through-hole a rotation pin is disposed, said pin being fixed to a corresponding support provided within the body.

4. The diving mask according to claim 3, wherein said bow-shaped lever has an abutment pin for said grasping element of said bow-shaped lever, said grasping element at least partially protruding from a front portion of said body when said bow-shaped lever is in a quiescent position.

5. The diving mask according to claim 3, wherein said grasping element is rotatably connected to the grasping end of said bow-shaped lever, allowing rotation of said grasping element with respect to said bow-shaped lever at least towards the outside of the mask.

6. The diving mask according to claim 5, wherein said grasping element is rotatably connected to the grasping end of said bow-shaped lever by a pin housed within a corresponding hole near said end.

7. The diving mask according to claim 3, wherein said grasping element comprises a side and/or front portion for grasping.

8. The diving mask according to claim 3, wherein the rotation pin of said bow-shaped lever is housed within a housing comprising a plurality of holes, said holes being provided in order to adjust the corresponding position of the compensation lever with respect to said body.

9. The diving mask according to claim 1, wherein said abutment comprises an elastic deformation element disposed near an end of said abutment and adapted to abut the corresponding nostril.

10. The diving mask according to claim 9, wherein said body comprises at least a suitably shaped hollow portion.

11. The mask according to claim 2, wherein, when said bow-shaped lever is in a quiescent position, a hollow portion of said body houses at least a part of said grasping element turned towards the inside said body.

12. The diving mask according to claim 1, wherein said abutment comprises means for regulating the position where said abutment abuts the corresponding nostril.

13. The diving mask according to claim 12, wherein said abutment is substantially L-shaped and said abutment comprising at least a stem and a base connected to said stem, said base having a threaded hole formed therethrough, said hole cooperating with a pin which can be screwed into said hole, said pin comprising, on one end, a head for the contact with the diver's nose nostril, and on the other end, an element for the adjustment of screwing said pin into said hole.

14. The diving mask according to claim 13, wherein said L-shaped abutment comprises, on the end having the head of said pin, another base which can be elastically deformed by screwing or unscrewing said pin, said head of the pin being placed between said bases and said other base being provided for the contact with the adjacent nostril.

15. The diving mask according to claim 1, wherein said body further comprises a second compensation lever, both compensation levers being provided with a hammer-shaped end placed beside a nostril of the diver's nose, said two levers being simultaneously turnable by the diver in order to carry out the simultaneous compression of both nostrils.

16. The diving mask according to claim 1, wherein a deformable housing is connected to the face of the mask and is located between the body and the diver's nose when said mask is positioned on the diver's face.

17. The mask according to claim 1, wherein said body is connected to said frame by means of screws or fitting elements.

18. The diving mask according to claim 1, wherein said compensation lever with a lever end rotatably connected to said body comprises a bow-shaped lever with a cam-shaped end rotateably connected to said body, said compensation lever extending transversely above the nose of a diver when said mask is positioned on the diver's face, said compensation lever being rotatable away from, and toward the outside of said mask, thereby urging said cam-shaped end to compress at least one nostril of the diver.

19. A diving mask with compensation, said diving mask comprising:

an outer frame and an inner face connected to said outer frame, said frame comprising a body shaped so as to house a diver's nose;

a compression element associate with said body and positioned adjacent one side of a diver's nose when said mask is positioned on the diver's face, said compression element being secured to said body and operable by the diver from the outside of the mask to compress at least one of the diver's nostrils; and at least one abutment on a side opposite said compression element side and adjacent the other side of a diver's nose when nose when said mask is positioned on the diver's face, said abutment comprises means for regulating a position of where said abutment abuts the corresponding nostril, said abutment being substantially L-shaped and said abutment comprising at least a stem and a base connected to said stem, said base having a threaded hole formed therethrough, said hole cooperating with a pin which can be screwed into said hole, said pin comprising on one end a head for the contact with the diver's nose nostril and on the other end an element for the adjustment of its screwing into said hole.

* * * * *